US006132538A

United States Patent [19]

Mendenhall et al.

[11] Patent Number: 6,132,538

[45] Date of Patent: Oct. 17, 2000

[54] HIGH GAS YIELD GENERANT COMPOSITIONS

[75] Inventors: Ivan V. Mendenhall, Providence; Robert D. Taylor, Hyrum; Michael W. Barnes, Brigham City, all of Utah

[73] Assignee: Autoliv Development AB, Vargarda, Sweden

[21] Appl. No.: 09/124,944

[22] Filed: Jul. 30, 1998

[51] Int. Cl.[7] ..... C06B 31/28; C06B 31/56

[52] U.S. Cl. ..... 149/46; 149/48

[58] Field of Search ..... 149/46, 48, 19.91, 149/19.6

[56] References Cited

U.S. PATENT DOCUMENTS

| | | | |
|---|---|---|---|
| 2,220,891 | 11/1940 | Cook et al. . | |
| 2,904,420 | 9/1959 | Holker . | |
| 3,002,830 | 10/1961 | Barr . | |
| 3,067,076 | 12/1962 | Butcher et al. . | |
| 3,144,367 | 8/1964 | Enoksson | 149/8 |
| 4,925,600 | 5/1990 | Hommel et al. | 264/3.4 |
| 5,125,684 | 6/1992 | Cartwright | 280/736 |
| 5,542,998 | 8/1996 | Bucerius et al. | 149/45 |
| 5,542,999 | 8/1996 | Bucerius et al. | 149/45 |
| 5,545,272 | 8/1996 | Poole et al. | 149/48 |
| 5,592,812 | 1/1997 | Hinshaw et al. | 60/205 |
| 5,608,183 | 3/1997 | Barnes et al. | 149/45 |
| 5,641,938 | 6/1997 | Holland et al. | 149/48 |
| 5,663,524 | 9/1997 | Bucerius et al. | 149/45 |
| 5,677,510 | 10/1997 | Bucerius et al. | 149/45 |
| 5,725,699 | 3/1998 | Hinshaw et al. | 149/19.1 |
| 5,726,382 | 3/1998 | Scheffee et al. | 149/19.91 |
| 5,735,118 | 4/1998 | Hinshaw et al. | 60/219 |
| 5,747,730 | 5/1998 | Scheffee et al. | 149/47 |
| 5,847,315 | 12/1998 | Katzakian, Jr. et al. | 149/19.91 |
| 5,850,053 | 12/1998 | Scheffee et al. | 149/19.91 |
| 5,866,842 | 2/1999 | Wilson et al. | 149/19.6 |

FOREIGN PATENT DOCUMENTS 44 42 169 C1 of 0000 Germany .

*Primary Examiner*—Michael J. Carone
*Assistant Examiner*—Aileen J. Baker
*Attorney, Agent, or Firm*—Sally J. Brown

[57] ABSTRACT

Gas generant compositions, such as may be suited for use in inflating automotive inflatable restraint airbag cushions, are provided. Such gas generant compositions generally contain a mixture of guanidine nitrate, ammonium nitrate, and a transition metal ammine nitrate, such as copper diammine dinitrate and preferably also contain one or more ballistic additives.

20 Claims, No Drawings

HIGH GAS YIELD GENERANT COMPOSITIONS

BACKGROUND OF THE INVENTION

This invention relates generally to gas generant materials and, more particularly, to high gas yield generant compositions such as may be suited for use in inflating automotive inflatable restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as "an inflator."

While many types of inflator devices have been disclosed in the art for use in the inflating of one or more inflatable restraint system airbag cushions, inflator devices which rely on the combustion of a pyrotechnic, fuel and oxidizer combination or other form of gas generant to produce or at least in part form the inflation gas issuing forth therefrom have been commonly employed in conjunction with vehicular inflatable restraint airbag cushions.

At the present time, sodium azide is a commonly accepted and used gas generating material. While the use of sodium azide and certain other azide-based gas generant materials meets current industry specifications, guidelines and standards, such use may involve or raise potential concerns such as involving handling, supply and disposal of such materials.

In addition, economic and design considerations have also resulted in a need and desire for alternatives to azide-based pyrotechnics and related gas generants. For example, interest in minimizing or at least reducing overall space requirements for inflatable restraint systems and particularly such requirements related to the inflator component of such systems has stimulated a quest for gas generant materials which provide relatively higher gas yields per unit volume as compared to typical or usual azide-based gas generants. Further, automotive and airbag industry competition has generally lead to a desire for gas generant compositions which satisfy one or more conditions such as being composed of or utilizing less costly ingredients or materials and being amenable to processing via more efficient or less costly gas generant processing techniques.

As a result, the development and use of other suitable gas generant materials has been pursued. Thus, efforts have been directed to the development of azide-free pyrotechnics for use in such inflator device applications. In particular, there is a need and a desire for an azide-free gas generant material that, while overcoming at least some of the potential problems or shortcomings of azide-based gas generants, may also provide relatively high gas yields, such as compared to typical azide-based gas generants. In particular, relatively low cost gas generant material solutions to one or more such problems or limitations are desired.

SUMMARY OF THE INVENTION

A general object of the invention is to provide an improved gas generant material.

A more specific objective of the invention is to overcome one or more of the problems described above.

The general object of the invention can be attained, at least in part, through a gas generant composition which includes a mixture of guanidine nitrate, ammonium nitrate, and a transition metal ammine nitrate.

The prior art fails to provide gas generant materials which provide relatively higher gas yields per unit volume as compared to typical or usual azide-based gas generants and which gas generant material is composed of or utilizes less costly ingredients or materials and is amenable to processing via more efficient or less costly gas generant processing techniques.

The invention further comprehends a melt-processible gas generant composition which includes: 35–60 wt % guanidine nitrate, 30–60 wt % ammonium nitrate, 3–12 wt % copper diammine dinitrate and 5–15 wt % of ballistic additive selected from the group of $ZrO_2$, $TiO_2$, $SiO_2$, $Al_2O_3$, bentonite and combinations thereof.

"Equivalence ratio" ($\phi$), also sometimes referred to as "E.R.," is an expression commonly used in reference to combustion and combustion-related processes. Equivalence ratio is defined as the ratio of the actual fuel to oxidant ratio $(F/O)_A$ divided by the stoichiometric fuel to oxidant ratio $(F/O)_S$:

$$\phi=(F/O)_A/(F/O)_S \quad (1)$$

(A stoichiometric reaction is a unique reaction defined as one in which all the reactants are consumed and converted to products in their most stable form. For example, in the combustion of a hydrocarbon fuel with oxygen, a stoichiometric reaction is one in which the reactants are entirely consumed and converted to products entirely constituting carbon dioxide ($CO_2$) and water vapor ($H_2O$). Conversely, a reaction involving identical reactants is not stoichiometric if any carbon monoxide (CO) is present in the products because CO may react with $O_2$ to form $CO_2$, which is considered a more stable product than CO.)

Unless otherwise noted, percentages are in weight percent, with the weight percent of particular materials being calculated relative to a total gas generant composition corresponding to 100 weight percent.

Other objects and advantages will be apparent to those skilled in the art from the following detailed description taken in conjunction with the appended claims.

DETAILED DESCRIPTION OF THE INVENTION

The present invention provides gas generant compositions which typically include guanidine nitrate, ammonium nitrate, and at least one transition metal ammine nitrate, preferably copper diammine dinitrate. In particular, gas generant compositions in accordance with the invention have been found to generate in excess of about 3 moles of gas, preferably at least about 3.5 moles of gas and, more preferably, at least about 4 moles or more of gas per 100 grams of composition and at combustion or flame temperatures in the range of about 1900 K to about 2100 K.

In such compositions, guanidine nitrate primarily serves as a fuel material. As will be appreciated, through such incorporation and use, guanidine nitrate can provide a generally readily available, lower cost and oxygen rich replacement to previous gas generant composition fuel materials such as hexammine cobalt (III) nitrate, for example.

The ammonium nitrate incorporated in the subject gas generant compositions primarily functions, serves or acts as an oxidizer in reaction association with the guanidine nitrate. Such use of ammonium nitrate can be particularly advantageous as ammonium nitrate is generally an exceptionally effective oxidizer on a per unit weight basis and desirably yields a non-toxic and non-corrosive exhaust at relatively low flame temperatures. Still further, ammonium nitrate constitutes a relatively low cost and readily available component material for inclusion in such compositions and may thus serve to enhance the likelihood of greater or more widespread use of corresponding compositions containing such a component material.

As will be appreciated by those skilled in the art, however, the greater or more widespread use or incorporation of ammonium nitrate in gas generant compositions has been generally limited or restricted due to certain phase changes such material may typically undergo in association with temperature variations such as may be normally associated with such anticipated uses. Specifically, ammonium nitrate may generally undergo phase changes in association with temperature variations such as may with undesired frequency result in cracks or voids in the resulting gas generant material. Further, continued temperature cycling may result in sufficient degradation of corresponding gas generant material form to render such material as unsuitable for inflatable restraint device gas generation. For example, such temperature cycling may result in the gas generant material form degrading into a powder or other form such as may be unsuitable or undesirable for at least certain inflatable restraint gas generant applications.

The inclusion of a transition metal ammine nitrate in a preferred gas generant composition in accordance with the invention serves, at least in part, as a phase stabilizer for the ammonium nitrate. As described in greater detail below, it has been found that phase stabilization of ammonium nitrate with a transition metal ammine nitrate such as copper diammine dinitrate provides various processing and product advantages. While the addition and use of other materials, such as potassium salts, e.g., nitrates and perchlorates, for ammonium nitrate stabilization have been previously disclosed and are known, such addition or use of potassium salts may be prone or subject to one or more significant processing or use limitations. For example, the combustion products typically associated with the combustion of potassium salt materials such as potassium nitrate and potassium perchlorate, e.g., combustion products such as $K_2O$, $K_2CO_3$ and KCl, typically have undesirably low melting and boiling temperatures such as may render as difficult the separation and removal, such as by filtration, of such combustion products from the gaseous effluent of a corresponding inflator device. Further, at least certain of such potassium oxide and carbonate combustion products are basic and may present additional potential complications or problems. For example, at least certain individuals, including various asthmatic vehicle occupants, may experience respiratory difficulties as a result of the presence of such combustion products issuing forth from an associated inflator device.

In contrast, the preferred use of a transition metal ammine salt, such as an ammine salt of nickel, zinc or, preferably copper, such as preferably the copper ammine salt copper diammine dinitrate, typically produces or forms the corresponding metal material, e.g., copper metal in the case of copper diammine dinitrate, as the primary and preferably only liquid combustion product. As will be appreciated, such copper metal typically readily solidifies and is generally relatively easily filterable. Further, the preferred addition of transition metal ammine nitrates may also desirably result in compositions which are less hygroscopic, as compared to similar compositions containing such potassium salt ammonium nitrate phase stabilizers.

Transition metal ammine salts, however, may be prone or subject to hydrolysis reactions in water unless aqueous processing is preferably accomplished such as by means of the inclusion of high relative amounts of ammonia. The occurrence of such hydrolysis reactions can be overcome through melt-processing of the corresponding compositions. As will be appreciated, the melt-processing of the compositions of the invention may also provide a simplified means of better assuring the formation and production of a desirably homogenous and uniform product.

In view of the above, melt-processing is a preferred processing technique for use in conjunction with the gas generant compositions of the invention. Such melt-processing of the subject gas generant composition components may take various forms. For example, a dry blended mixture of such components can be extruded. Alternatively, such components can be planetary mixed in a molten condition, cooled, granulated and then extruded, injection molded, or tableted, as desired. In accordance with another alternative, a molten mixture of such a composition can sprayed dried to form solid prills and then extruded, tableted or injection molded, as desired.

It is also to be appreciated that in addition to serving to assist in the phase stabilization of ammonium nitrate, the inclusion of a transition metal ammine nitrate such as copper diammine dinitrate in gas generant compositions of the invention may also, at least in part, serve as a supplementary or auxiliary oxidizer in the combustion of the guanidine nitrate. In a preferred gas generant composition of the invention, the amount of copper ammine dinitrate constitutes no more than about 20 percent of the total mass of oxidizer (ammonium nitrate and copper diammine dinitrate) in the composition, preferably copper diammine dinitrate is present in a relative amount of about 10% to about 20% of the total of the mass of the copper diammine dinitrate and ammonium nitrate of such compositions.

In practice, copper diammine dinitrate can be formed within the melt phase of processing by the addition of CuO which reacts with ammonium nitrate to produce copper diammine dinitrate and a small quantity of water.

In accordance with one preferred embodiment of the invention, a gas generant composition mixture of guanidine nitrate, ammonium nitrate, and copper diammine dinitrate cooperate to form a eutectic mixture (i.e., the melting point of the mixture is less than the melting point of any one of these composition mixture ingredients). As will be appreciated, that these ingredients cooperate to form such a eutectic mixture can generally desirably facilitate the processability of the composition as a molten liquid or solution, with or without solids dispersed therein. For example, it has been found that through the lower temperature melt processing afforded by such a eutectic material, higher temperatures such as at which components such as copper diammine dinitrate may decompose can be avoided.

Preferably, the gas generant compositions of the invention desirably also contain one or more additives. Such additives typically function to satisfy one or more of the following conditions: increase the burn rate of the gas generant composition; improve the handling or other material characteristics of the slag which remains after combustion or reaction of the gas generant material; and improve either or both the ability to handle or process the gas generant material. For ease of reference, such additives are generally hereinafter referred to as "ballistic additives."

The compositional inclusion of such ballistic additive may also allow or permit the avoidance or overcoming of a potential or possibly inherent problem with eutectic formulations of ammonium nitrate and guanidine nitrate. More specifically, a gas generant such as composed of such a eutectic formulation may normally or otherwise be subject to surface melting and self-extinguishment when exposed to heat, such as from an igniter, for example. The compositional inclusion of a ballistic additive as described herein, however, can serve to make the generant more ignitable such as through the inhibition of surface melting.

Some specific examples of preferred ballistic additives for use in the practice of the invention include $ZrO_2$, $TiO_2$, $SiO_2$, $Al_2O_3$, bentonite and combinations thereof. Particularly preferred ballistic additive materials for incorporation into the gas generant compositions of the invention include $SiO_2$ and combinations of $SiO_2$ and $Al_2O_3$. These ballistic additive materials are generally preferred as they typically advantageously are of lower relative costs.

As identified above, the inclusion of such ballistic additives can function to desirably increase the bum rate of the corresponding composition. In general, the bum rate of the composition increases as the ballistic additive concentration in the composition is increased. In a preferred gas generant composition of the invention, the mole ratio of copper diammine dinitrate to ballistic additive contained therewithin is carefully controlled to better assure the formation of slag having acceptable properties such as facilitate the filtration of such slag from a corresponding gaseous effluent. In practice, mole ratio of ballistic additive to copper diammine dinitrate is maintained at an amount no greater than 3, preferably the mole ratio of ballistic additive to copper diammine dinitrate is maintained within a range of about 1 to about 3.

The compositional inclusion of such ballistic additive materials may also advantageously provide or result in an improved slag product. As will be appreciated, slag products which are more easily filtered or otherwise handled and are thus generally considered "improved." While not wishing to be bound by any particular theory or explanation, such improved slag product is believed to be at least partially attributable to the generally higher melting points of such preferred ballistic additives.

While gas generant composition mixtures of guanidine nitrate, ammonium nitrate, and copper diammine dinitrate in accordance with at least certain preferred embodiments of the invention and as described above desirably cooperate to form a eutectic mixture, ballistic additives included in such compositions do not generally enter such solutions but rather may take the form of solid particles dispersed within a melt phase formed by the guanidine nitrate, ammonium nitrate, and copper diammine dinitrate.

In particularly preferred gas generant compositions of the invention include:

a) guanidine nitrate present in a concentration of about 35 wt % to about 60 wt % of the composition;

b) ammonium nitrate present in a concentration of about 30 wt % to about 60 wt % of the composition;

c) copper diammine dinitrate present in a concentration of about 3 wt % to about 12 wt % of the composition; and d) ballistic additive present in a concentration of about 5 wt % to about 15 wt % of the composition.

The present invention is described in further detail in connection with the following examples which illustrate/simulate various aspects involved in the practice of the invention. It is to be understood that all changes that come within the spirit of the invention are desired to be protected and thus the invention is not to be construed as limited by these examples.

EXAMPLES

Examples 1 and 2

Gas generant compositions in accordance with the invention were prepared and formulated as shown in TABLE 1, below. The composition of each of Examples 1 and 2 were then reacted (burned). TABLE 2, below, shows values, calculated or obtained for or in each of Examples 1 and 2 for equivalence ratio (E.R.), combustion temperature (CT), gas output (GO) measured in terms of a) moles of gas produced per 100 grams of composition and b) weight percent gas, linear burn rate at 1000 psi (LBR), Exponent and Coefficient (where the exponent is the slope of the plot of the log of pressure along the x-axis versus the log of the burn rate along the y-axis; the coefficient is the base 10 exponent of the log burn rate-axis intercept from the same plot and the knowledge of which exponent and coefficient permits the determination of the burn at a selected pressure).

TABLE 1

| | Example 1 | Example 2 |
|---|---|---|
| Guanidine nitrate | 41.09 | 53.04 |
| Ammonium nitrate | 51.05 | 39.70 |
| Cupric oxide | 2.86 | 2.26 |
| Silica | 5.00 | 5.00 |

TABLE 2

| | Example 1 | Example 2 |
|---|---|---|
| E.R. | 1.0 | 0.90 |
| CT (K) | 2122 | 1933 |
| GO | | |
| a) | 3.93 | 4.09 |
| b) | 92.71 | 98.49 |
| LBR (ips) | 0.3 | 0.3 |
| Exponent | 0.6 | 0.6 |
| Coefficient | 0.002 | 0.002 |

Discussion of Results

As demonstrated by the results obtained in Examples 1 and 2, the gas generant compositions of the invention afford high gas yields while reacting or burning at reasonable temperatures. In view thereof, the attractiveness of the subject gas generant compositions is believed apparent.

In view of the above, the subject invention is believed to provide an azide-free gas generant material that, while overcoming at least some of the potential problems or shortcomings of azide-based gas generants, also provides or results in relatively high gas yields, such as compared to typical azide-based gas generants. In particular, the invention may provide or result in a relatively low cost gas generant material solutions to one or more of the above-identified problems or limitations of conventional gas generant formulations.

It is to be understood that the discussion of theory, such as the discussion of the possible rationale for the beneficial inclusion of a ballistic additive, relating to the inhibition of surface melting, for example, is included to assist in the understanding of the subject invention and is in no way limiting to the invention in its broader application.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generant composition comprising a mixture of guanidine nitrate, ammonium nitrate and a transition metal ammine nitrate and additionally comprising a ballistic additive, wherein the ballistic additive is present in a concentration of about 5 wt % to about 15 wt % of the composition.

2. The composition of claim 1 wherein the transition metal ammine nitrate is copper diammine dinitrate.

3. A gas generant of the composition of claim 2 wherein said copper diammine dinitrate is formed by adding copper oxide to a quantity of ammonium nitrate and wherein guanidine nitrate, ammonium nitrate, copper oxide and ballistic additive are processed in a molten mass.

4. The composition of claim 1 wherein the ballistic additive is selected from the group of $ZrO_2$, $TiO_2$, $SiO_2$, $Al_2O_3$, bentonite and combinations thereof.

5. The composition of claim 4 wherein the ballistic additive is $SiO_2$.

6. A gas generant of the composition of claim 1 wherein guanidine nitrate, ammonium nitrate, copper diammine dinitrate and ballistic additive are processed in a molten mass.

7. A gas generant composition comprising a mixture of guanidine nitrate, ammonium nitrate and copper diammine dinitrate, wherein said copper diammine dinitrate is present in a concentration of about 3 wt % to about 12 wt % of the composition.

8. The composition of claim 7 having the form of a eutectic mixture.

9. The composition of claim 7 wherein the guanidine nitrate is present in a concentration of about 35 wt % to about 60 wt % of the composition.

10. The composition of claim 7 wherein the ammonium nitrate is present in a concentration of about 30 wt % to about 60 wt % of the composition.

11. The composition of claim 7 wherein said copper diammine dinitrate is formed by adding copper oxide to a quantity of ammonium nitrate.

12. A gas generant composition comprising a mixture of guanidine nitrate, ammonium nitrate and copper diammine dinitrate and additionally comprising a ballistic additive, wherein the molar ratio of ballistic additive to copper diammine dinitrate is about 1 to about 3.

13. A gas generant composition comprising a mixture of guanidine nitrate, ammonium nitrate, and copper diammine dinitrate, wherein said copper diammine dinitrate is present in a relative amount of about 10% to about 20% of the total of the mass of the copper diammine dinitrate and ammonium nitrate.

14. The composition of claim 13 wherein the guanidine nitrate is present in a concentration of about 35 wt % to about 60 wt % of the composition.

15. The composition of claim 13 wherein the ammonium nitrate is present in a concentration of about 30 wt % to about 60 wt % of the composition.

16. A gas generant composition comprising a mixture of guanidine nitrate, ammonium nitrate and a transition metal ammine nitrate and additionally comprising a ballistic additive, wherein the ballistic additive is a combination of $SiO_2$ and $Al_2O_3$.

17. The composition of claim 16 wherein the transition metal ammine nitrate is copper diammine dinitrate.

18. A melt-processible gas generant composition comprising:

35–60 wt % guanidine nitrate,

30–60 wt % ammonium nitrate,

3–12 wt % copper diammine dinitrate and

5–15 wt % of ballistic additive selected from the group of $ZrO_2$, $TiO_2$, $SiO_2$, $Al_2O_3$, bentonite and combinations thereof.

19. The melt-processible gas generant composition of claim 18 wherein the composition forms a eutectic mixture.

20. The melt-processible gas generant composition of claim 18 wherein the molar ratio of ballistic additive to copper diammine dinitrate is in the range of about 1 to about 3.

* * * * *